United States Patent [19]

Kleisser et al.

[11] 3,966,244

[45] June 29, 1976

[54] INSTALLATION FOR SECURING OF PIVOTAL HOODS OR FLAPS, ESPECIALLY ENGINE HOODS

[75] Inventors: Werner Kleisser, Ostelsheim; Götz Mötting, Sindelfingen, both of Germany

[73] Assignee: Daimler-Benz Aktiengesellschaft, Germany

[22] Filed: Dec. 23, 1974

[21] Appl. No.: 535,984

[30] Foreign Application Priority Data

Dec. 24, 1973 Germany ..... 2364466

[52] U.S. Cl. ..... 292/127; 70/240; 70/464; 292/DIG. 14

[51] Int. Cl.[2] ..... E05C 19/10

[58] Field of Search ..... 292/127, 99, 227, 262, 292/277, DIG. 14, DIG. 38, DIG. 43, 336.3; 70/208, 464, 240

[56] References Cited

UNITED STATES PATENTS 2,227,144 12/1940 Krause ..... 29/11 X 3,767,244 10/1973 Plaw ..... 292/227

*Primary Examiner*—Robert L. Wolfe

*Attorney, Agent, or Firm*—Craig & Antonelli

[57] ABSTRACT

An installation for securing pivotal hoods or flaps, particularly engine hoods for motor vehicles, which are unlatched from the interior space of the vehicle and can be released externally from a locked or stop position by a lever secured at a safety hook which itself is pivotally mounted spring-loaded at the hood and cooperates with a fixed counter-member; after the release of the interior latching mechanism, the safety hook is pivoted into a locking or stop position by an upwardly directed movement of the hood, in the course of which the lever pivotally mounted at the safety hook is displaced out of a normal, covered-off position into an externally accessible position for the disengagement out of the stop position.

22 Claims, 3 Drawing Figures

INSTALLATION FOR SECURING OF PIVOTAL HOODS OR FLAPS, ESPECIALLY ENGINE HOODS

The present invention relates to an installation for securing pivotal hoods or flaps, especially engine hoods for motor vehicles, which are unlatched from the interior space of the vehicle and are externally released out of a locking or stop position by means of a handle lever secured at a safety hook.

In already known constructions of hood securing arrangements against an unintentional pivoting up of the hood after the release of the latching mechanism, an arrangement and assembly of safety hooks is provided at the vehicle only at such places which are readily accessible by hand from below or by extending through for a direct actuation thereof. This, however, is not possible as a rule when the safety hook is arranged forwardly within the area of the vehicle center underneath the pivotal engine hood which is securely connected with a downwardly projecting radiator covering (radiator grille) so that the safety hook with a closed hood cannot be released in a simple manner out of its locked or stop position.

The present invention is therefore concerned with the task to eliminate this disadvantage by an installation simple and effective from a structural and manufacturing point of view with safety hooks which, while maintaining the main unlatching operation of the hood from the interior space of the vehicle, assures by its construction and by its mounting of suitable means, that the engine hood can be released manually in a simple manner from a secured locked or stop position.

The present invention essentially consists in that the safety hook, which is pivotally mounted at a hood springloaded and cooperates with a locally fixed counter-member, is pivoted after the release of the interior latching mechanism by an upwardly directed movement of the hood into a locked or stop position in which the handle lever pivotally connected at the safety hook is displaced out of a covered-off, normal position into a position accessible from the outside for the disengagement of the locked or stop position.

In one advantageous embodiment of the present invention, the safety hook is constructed sickle-shaped and is provided with a curved butting surface which on one side of the safety hook passes over into a detent or stop notch provided with a locking nose portion which is adjoined by a crowned or spherical sliding surface, and in that the safety hook is provided on its other side adjacent the point of pivotal connection with a finger-shaped crowned cam.

According to another feature of the present invention, the locally fixed counter-member provided with a detent edge, which is secured at the frame of the vehicle front end section, consists of a deflection plate coated with a slide-resistant, low-friction material, for example, of synthetic resinous material of known type, which deflection plate slopes obliquely downwardly in the forward direction.

Finally, one embodiment of the present invention is characterized by the fact that the safety hook is retained in its normal position by a spring with a closed and opened, pivoted up hood whereby the handle lever pivotally connected at the safety hook is guided and supported covered-off in a radiator grille connected with the hood.

Accordingly, it is an object of the present invention to provide an installation for securing flaps, pivotal hoods or the like which avoids by simple means the aforementioned shortcomings and drawbacks encountered in the prior art.

Another object of the present invention resides in an installation for securing pivotal hoods or flaps, especially engine hoods of motor vehicles, in which the safety hook can be released out of its stop position in a simple manner even though the hood is securely connected with a radiator grille which projects downwardly from the hood.

A further object of the present invention resides in an installation for securing pivotal hoods or flaps, especially engine hoods for motor vehicles, which is simple in structure, can be easily manufactured and ensures a reliable and afe operation by the use of a safety hook.

Still another object of the present invention resides in an installation for securing pivotal engine hoods of motor vehicles which are adapted to be unlatched from the inside of the passenger space and which can be released manually by simple means from the outside once the interior unlatching has taken place.

These and further objects, features and advantages of the present invention will become more apparent from the following description when taken in connection with the accompanying drawing which shows, for purposes of illustration only, one embodiment in accordance with the present invention, and wherein.

Figure 1:
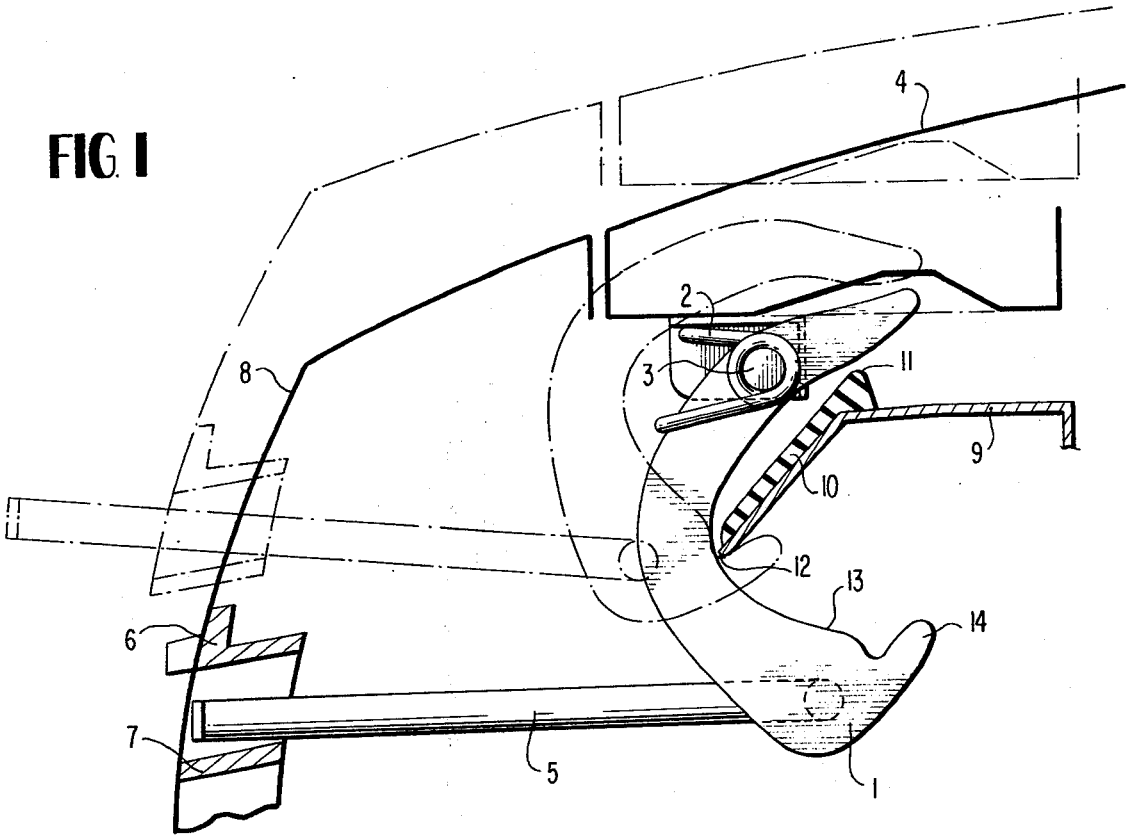
FIG. 1 is a schematic side elevational view, partly in cross section, of a securing installation in accordance with the present invention with a closed and unlatched engine hood and with the safety hook in the normal rest and in the locking or stop position, respectively.

Referring now to the drawing wherein like reference numerals are used throughout the various views to designate like parts, and more particularly to FIG. 1, this figure illustrates a safety hook 1 according to the present invention in its normal rest position which is pivotally mounted at an engine hood 4 by means of a pivot bolt 3 under the prestress of a spring 2 whereby the engine hood 4 is shown in the closed position in full line. A manual handle or gripping lever 5 is pivotally connected at the lower free end of the safety hook 1 which with its other free end is guided and supported between the radiator grille rods 6 and 7 of a radiator grille 8 secured at the engine hood 4 so as to be covered thereby.

A locally fixed counter-member 9 with a detent or locking edge 12 is mounted in the center of the frame of the vehicle front section (not shown), which is provided on its forward, obliquely downwardly sloping side with a deflecting plate 10 that includes at the top a rounded-off portion 11. As soon as the hood locking and latching mechanism of conventional construction (not shown) is unlatched from the interior space of the vehicle, the engine hood 4 which is under spring-stress and is supported within the area underneath the vehicle front end, pivots upwardly together with the radiator grille 8 into the locking or stop position illustrated in dash and dot lines whereby the safety hook 1 slide along the detent edge 12 with its curved butting surfae 13 until it engages with its locking nose portion 14 as shown in the drawing in dash and dotted lines. It is achieved thereby that the handle lever 5 pivotally mounted at the safety hook 1 is displaced into a position accessible from the outside which makes it possible to manually disengage and unlock by means of the same the locking nose portion 14 of the safety hook and to open the hood together with the radiator grille 8.

Figure 2:
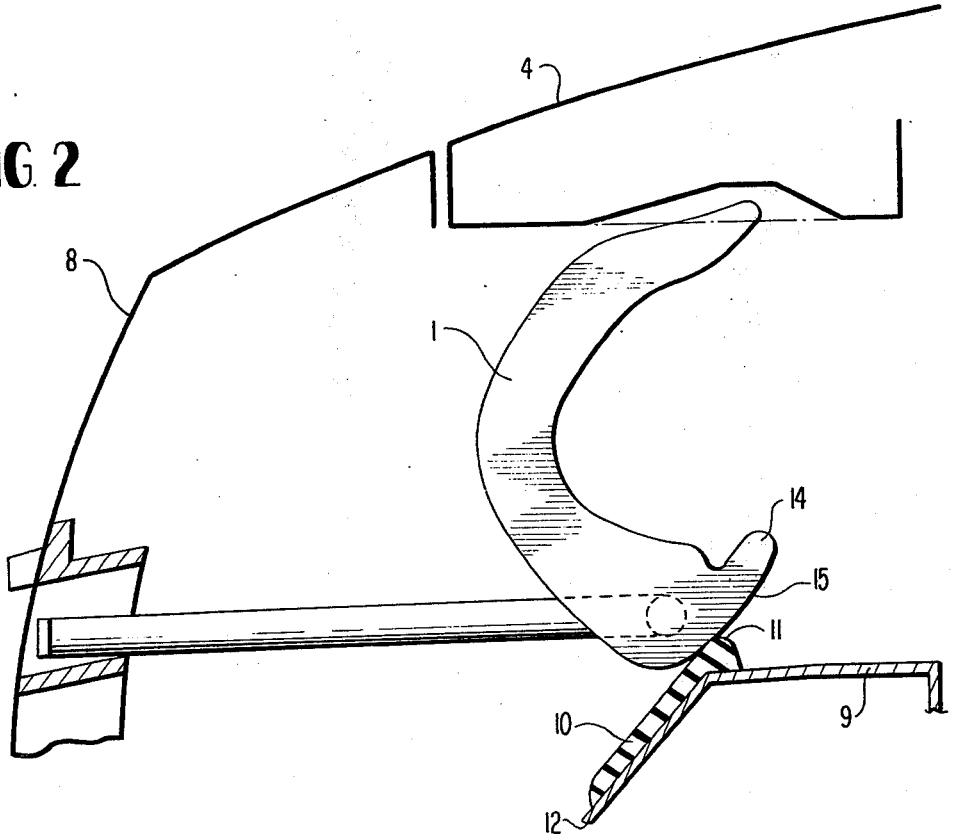
FIG. 2 is a schematic side elevational view, similar to FIG. 1, with an opened engine hood and with the safety hook in the normal rest position.

FIG. 2 illustrates the opened hood 4, 8 during the beginning of a closing operation. The curved or crowned slide surface 15 of the safety hook 1 thereby encounters at first the rounded-off portion 11, is deflected thereat and slides along the deflecting plate 10 until the locking nose portion 14 engages behind the detent edge 12 so that then the hood when pressed down further, is seized and locked by the hood locking and latching mechanism (not shown).

Figure 3:
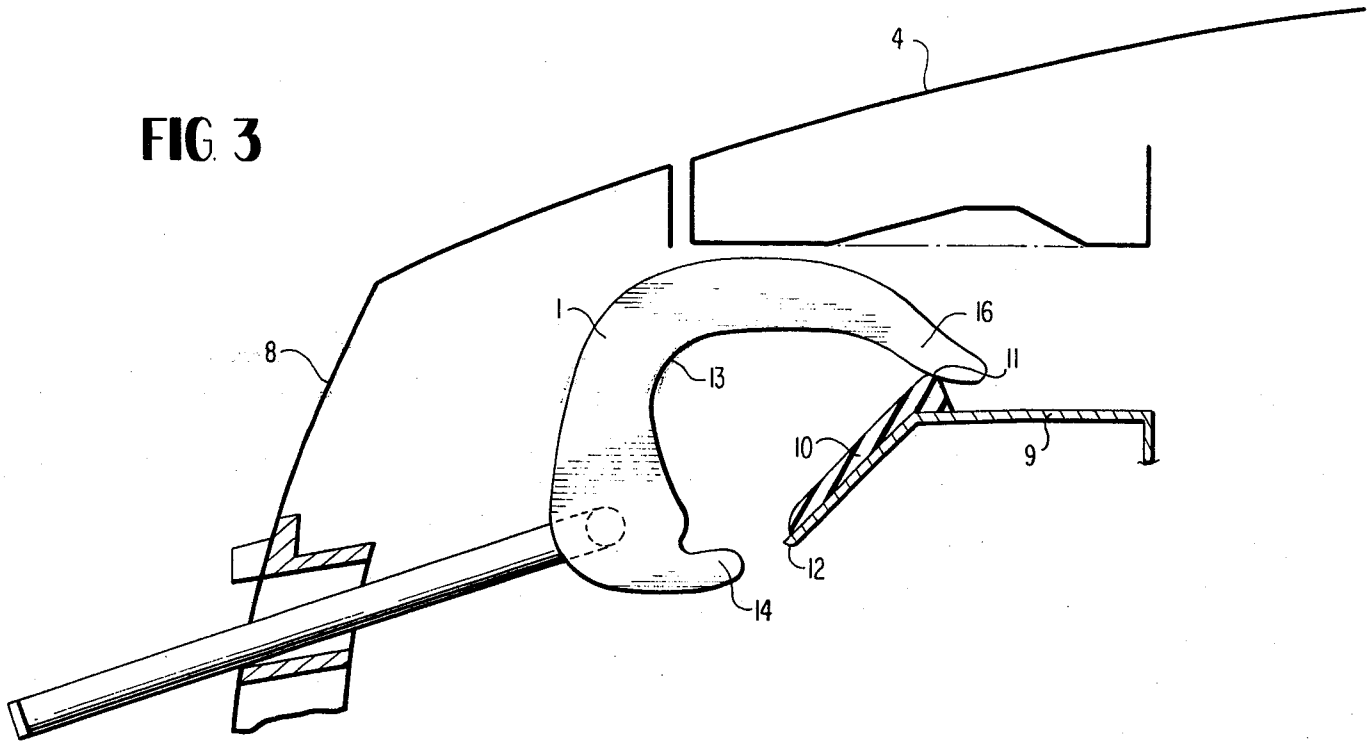
FIG. 3 is a schematic side elevational view, similar to FIG. 2, during the closing of the engine hood with automatic return of the safety hook into the normal position in case of a broken compression spring.

FIG. 3 illustrates similar to FIG. 2 the open hood 4, 8 during the beginning of a closing operation whereby, however, the spring 2 illustrated in FIG. 1 which continuously holds the safety hook 1 under prestress, has failed as a result of a defect or of strong soiling.

In that case, at first the finger-shaped, crowned cam portion 16 of the safety hook 1 then impinges against the rounded-off portion 11 and guides the same forcibly along the curved butting surface 13 when pressing down the hood 4, 8 up to a point where the detent edge 12 contacts the curved butting surface 13 and continues to slide along the same until the locking nose portion 14 again engages the detent edge 12 from behind. From then on the hood is displaced by a further pressing-down action into a fully latched position of the locking and latching mechanism.

The embodiment of the safety hook according to the present invention assures by the existing structural features in conjunction with the handle lever 5, the locally fixed counter-member 9 with its detent edge 12 and the deflecting plate 10 with its rounded-off portion 11, a completely satisfactory opening and closing of the engine hood 4, 8 — also in case of failure of the spring 2 — by a positive guidance and an automatic return of the safety hook 1.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An installation for securing pivotal members of vehicles, which can be unlatched from the interior space of the vehicle and can be released from the outside out of a stop position by a lever at a safety hook means, characterized in that the safety hook means is pivotally mounted at the pivotal member under a spring load and cooperates with a locally fixed counter-member, said safety hook means upon release of the interior latching member being pivoted ay an upwardly directly movement of said pivotal member into a stop position in which said lever, which is pivotally mounted at the safety hook means, is displaced out of a normal cover-off position into an externally accessible position for the disengagement out of the stop position, said safety hook means is constructed sickle-shaped and is provided below the pivotal axis with a curved butting surface means which passes over on one side of the safety hook means into a detent notch provided with a locking nose portion which is adjoined by a crowned sliding surface, the fixed counter member includes a stop edge against which said curved butting surface means lies after a release of the latching mechanism, said curved butting surface means being slidable along the stop edge up to said locking nose portion to thereby move said lever from the normal covered-off position to the externally accessible position, and in that said crowned sliding surface is engageable with said fixed counter-member to deflect the safety-hook means away from the fixed counter-member upon a closing of the pivotal member.

2. An installation according to claim 1, characterized in that said pivotal member is a hood.

3. An installation according to claim 1, characterized in that said pivotal member is a flap.

4. An installation according to claim 1, characterized in that said pivotal member is an engine hood.

5. An installation for securing pivotal members of vehicles, which can be unlatched from the interior space of the vehicle and can be released from the outside out of a stop position by a lever at a safety hook means, characterized in that the safety hook means is pivotally mounted under a spring load and cooperates with a locally fixed counter-member, said hook means upon release of the interior latching mechanism being pivoted by an upwardly directed movement of said pivotal member into a stop position in which said lever, which is pivotally mounted at the safety hook means, is displaced out of a normal covered-off position into an externally accessible position for the disengagement out of the stop position, and in that the safety hook means is constructed substantially sickle-shaped and is provided with a curved butting surface means which passes over on one side of the safety hook means into a detent notch provided with a locking nose portion which is adjoined by a crowned sliding surface, and in that the safety hook means is provided on its other side adjacent the point of pivotal connection thereof with a finger-shaped crowned cam means.

6. An installation according to claim 5, characterized in that the point of pivotal connection includes a joint bolt.

7. An installation according to claim 6, characterized in that a spring means normally prestresses said hook means.

8. An installation according to claim 7, characterized in that the fixed counter-member is secured at a frame part of the vehicle front section.

9. An installation according to claim 5, characterized in that said fixed counter-member including a stop edge means consists of a deflecting plate means coated with a slideresistant, low-friction material.

10. An installation according to claim 9, characterized in that said material is a synthetic resinous material.

11. An installation according to claim 10, characterized in that said deflection plate means slopes obliquely downwardly in the forward direction.

12. An installation according to claim 11, characterized in that the safety hook means with closed and opened, pivotal member is retained in its normal position by a spring means, whereby the lever pivotally connected at the safety hook means is guided and supported in a covered-off manner in a radiator grille connected with the hood.

13. An installation according to claim 12, characterized in that said pivotal member is an engine hood.

14. An installation according to claim 13, characterized in that a spring means normally prestresses said hook means.

15. An installation according to claim 14, characterized in that the fixed counter-member is secured at a frame part of the vehicle front section.

16. An installation for securing pivotal members of vehicles, which can be unlatched from the interior space of the vehicle and can be released from the outside out of a stop position by a lever at a safety hook means, characterized in that the safety hook means is pivotally mounted at the pivotal member under a spring load and cooperates with a locally fixed countermember, said hook means upon release of the interior latching mechanism being pivoted by an upwardly directed movement of said pivotal member into a stop position in which said lever, which is pivotally mounted as the safety hook means, is displaced out of a normal covered-off position into an externally accessible position for the disengagement out of the stop position, and in that the safety hook means with closed and opened, pivotal member is retained in its normal position by a spring means, whereby the lever pivotally connected at the safety hook means is guided and supported in a covered-off manner in a radiator grille connected with the hood.

17. An installation according to claim 1, characterized in that said fixed counter-member including a stop edge means consists of a deflecting plate means coated with a slide-resistant, low-friction material.

18. An installation according to claim 17, characterized in that said material is a synthetic resinous material.

19. An installation according to claim 17, characterized in that said deflection plate means slopes obliquely downwardly in the forward direction.

20. An installation according to claim 2, characterized in that a radiator grille means is connected to the hook, guide means are provided in said radiator grille means for guiding the movement of said lever from the normal covered-off position to the externally accessible position.

21. An installation according to claim 1, characterized in that means are provided on said safety hook means for guiding said safety hook means away from said fixed counter-member during a closing of the pivotal member upon the occurrence of a failure of the spring load.

22. An installation according to claim 21, wherein said means for guiding said safety hook means includes a crowned cam means provided on said safety hook means at an end thereof opposite said locking nose portion, said crowned cam means being engageable with a surface of the fixed counter-member during the closing of the pivotal member.

* * * * *